US006718952B2

(12) United States Patent
Finch

(10) Patent No.: US 6,718,952 B2
(45) Date of Patent: Apr. 13, 2004

(54) FUEL MODULE ASSEMBLY

(75) Inventor: James R. Finch, Grayville, IL (US)

(73) Assignee: Uis, Inc., Jersey City, NJ (US)

( * ) Notice: Subject to any disclaimer, the term of this patent is extended or adjusted under 35 U.S.C. 154(b) by 7 days.

(21) Appl. No.: 10/196,988

(22) Filed: Jul. 17, 2002

(65) Prior Publication Data

US 2004/0011336 A1 Jan. 22, 2004

(51) Int. Cl.[7] ..... F02M 37/04
(52) U.S. Cl. ..... 123/509; 123/514
(58) Field of Search ..... 123/509, 514

(56) References Cited

U.S. PATENT DOCUMENTS 2,767,736 A 10/1956 Lackinger
2,953,156 A 9/1960 Bryant
3,020,950 A 2/1962 Schraivogel et al.
3,049,171 A 8/1962 Neuerburg et al.
3,729,273 A 4/1973 Shimrony
4,397,333 A 8/1983 Liba et al.
4,431,027 A 2/1984 Sabina, Jr.
4,503,885 A 3/1985 Hall
4,860,714 A 8/1989 Bucci
4,911,134 A 3/1990 Olsson
5,341,842 A 8/1994 Chih et al.
5,396,872 A * 3/1995 Ruger et al. ..... 123/514
6,123,511 A * 9/2000 Sertier ..... 123/514
6,260,543 B1 * 7/2001 Chih ..... 123/509
6,273,131 B1 * 8/2001 Kleppner ..... 123/514
6,341,623 B1 * 1/2002 Channing ..... 123/514
6,343,589 B1 * 2/2002 Talaski et al. ..... 123/514
6,425,378 B1 * 7/2002 Frank ..... 123/514
6,457,459 B1 * 10/2002 Schelhas et al. ..... 123/514
6,502,558 B1 * 1/2003 Brunel ..... 123/509
6,505,644 B2 * 1/2003 Coha et al. ..... 123/514
6,520,161 B2 * 2/2003 Hazama ..... 123/509

FOREIGN PATENT DOCUMENTS

DE 2849461 11/1978

* cited by examiner

*Primary Examiner*—Thomas N. Moulis
(74) *Attorney, Agent, or Firm*—Polster, Lieder, Woodruff & Lucchesi, L.C.

(57) ABSTRACT

A fuel pump module (10) includes a fuel reservoir (R), fuel pump (26), manifold (32) connected to a pump outlet (30), a fuel line (FS) for supplying fuel to an engine (E), and a return line (FR) returning unconsumed fuel to the reservoir through a return valve (100). An external jet manifold (20) includes a nozzle (68) through which fuel is directed from the manifold, and a venturi (70) by which a low pressure region is created to draw fuel from a fuel tank (T) into the jet manifold where it is entrained and intermixed with other fuel and discharged into the reservoir. The return valve includes a plunger (122) biased to close the return valve when the fuel pump is shut off. High pressure fuel from the fuel pump acts on the plunger when the engine is running to open the valve.

23 Claims, 4 Drawing Sheets

FUEL MODULE ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to fuel modules for delivering fuel to internal combustion engines, and more particularly, to an improved fuel module having an improved jet pump design and an improved return fuel design.

Fuel modules installed in the fuel tank of an automotive engine typically include an electric fuel pump for pumping fuel to an internal combustion engine. Fuel is drawn from the tank into the pump's inlet through a fuel filter. The fuel pump raises the fuel pressure from a relatively low level to a pressure on the order of from 15–50 psi or greater. The outlet of the fuel pump module is connected to a fuel rail which routes the fuel to the intake manifold of the engine. Any excess fuel is returned back to the module, re-circulated through the fuel pump with new fuel, and returned to the engine for combustion.

Current fuel modules have a number of drawbacks. One is the efficient design and operation of a jet pump such as the pumping mechanism shown in U.S. Pat. No. 4,860,714. Another is the design and operation of a valving mechanism in the return path. Conventional return pump designs include a diaphragm which, if it fails, renders the return valve inoperative. The present invention addresses various problems with current fuel modules to provide an efficient fuel module usable with many internal combustion engines.

BRIEF SUMMARY OF THE INVENTION

In accordance with the invention, generally stated, a fuel module assembly installed in a vehicle's fuel tank includes a reservoir housing. A fuel pump installed in the housing draws fuel from the reservoir and pumps fuel at high pressure to a fuel injection system for the vehicle's engine. A manifold also installed in the housing and in fluid communication with the pump outlet routes the fuel through a supply line to the fuel injection system. Fuel not consumed by the engine flows back to the fuel module through a return line so to be discharged into the reservoir for redelivery to the engine. An improvement to the fuel module includes an external jet manifold assembly mounted to the reservoir housing. Fuel from the manifold is directed to the jet manifold assembly and flows through a nozzle portion of the assembly. The jet manifold assembly also includes a venturi into which fuel drawn through the nozzle is discharged. This create a low pressure region and the suction created thereby draws fuel from the tank in which the fuel module is installed into the jet manifold assembly where it is entrained with fuel discharged from the nozzle. The outlet of the jet manifold assembly is in fluid communication with the reservoir to deliver the fuel to the reservoir. The result is that fresh fuel intermixed with recycled fuel is supplied to fuel pump for delivery to the engine.

In addition, the fuel directed back to the fuel module assembly through the return line is discharged into the reservoir through a fuel return valve. The return valve includes a spring loaded plunger mounted in a valve housing. The valve is interposed in the return path to the reservoir. When the engine is shut off, the spring biases the valve closed. When the engine is running, high pressure fuel from the fuel pump is routed through the manifold to act on the plunger and move the plunger against the force of the spring to open the return valve.

Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
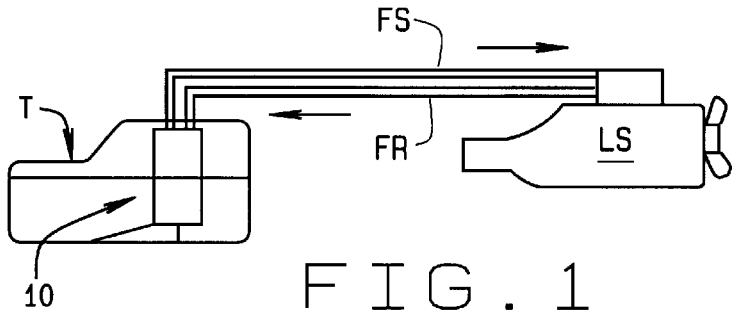
FIG. 1 is a simplified representation of a fuel system for an internal combustion engine.
Figure 2:
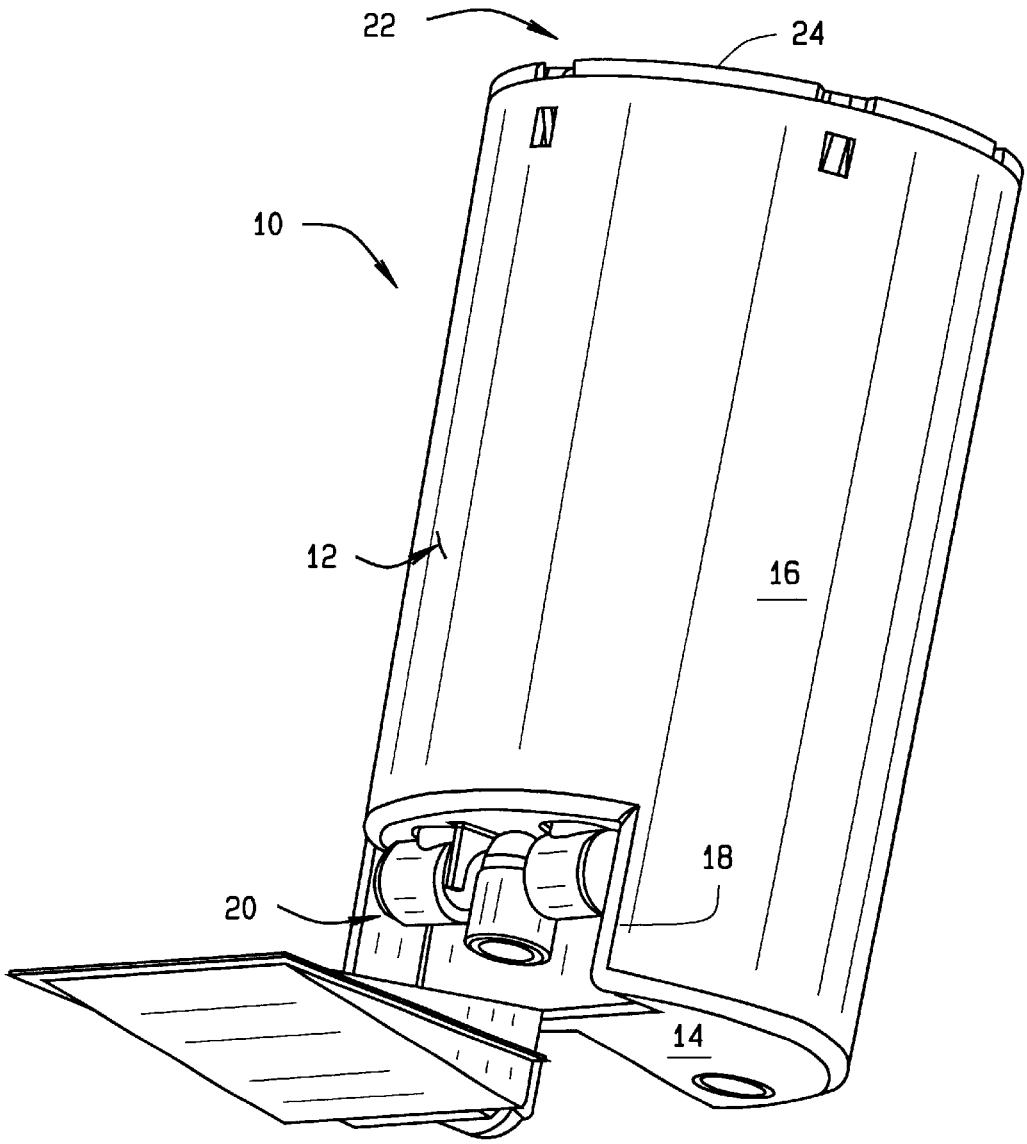
FIG. 2 is a perspective view of a fuel module including the improvements of the present invention.
Figure 3:
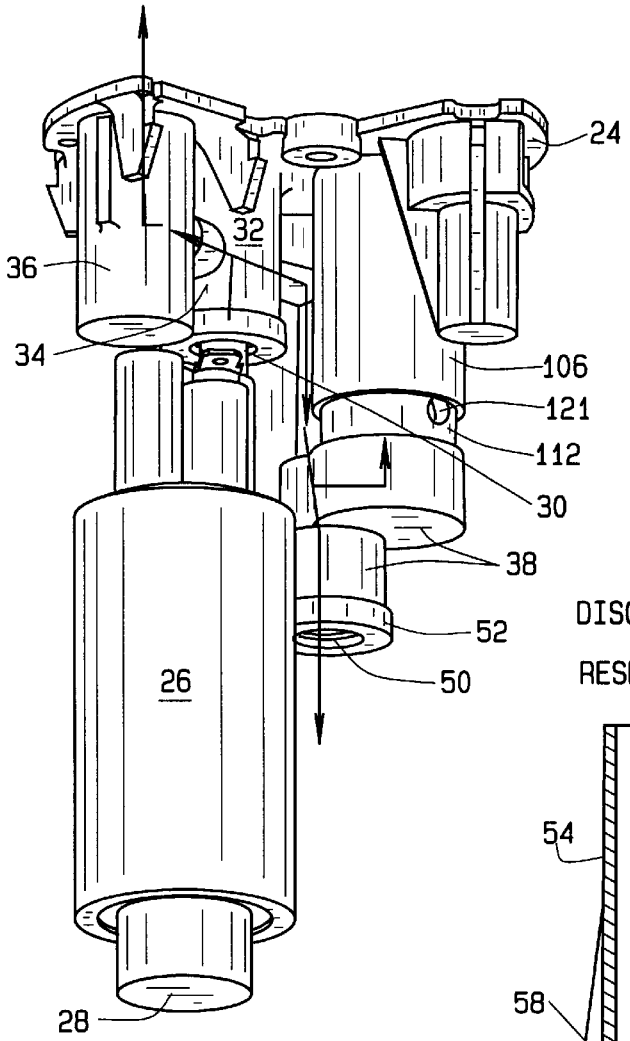
FIG. 3 is a perspective view of a fuel pump and manifold portion of the module.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Referring to the drawings, an improved fuel module of the present invention is indicated 10 in the drawings. The module is installed in a fuel tank T from which fuel is delivered to an internal combustion E through a fuel supply line FS. Fuel not consumed by the engine flows back to the module through a fuel return line FR. As described hereinafter, fuel module 10 has two improvements over present module constructions. The first is a jet manifold assembly indicated generally 20 in the drawings which is mounted externally of the fuel module. The other is a fuel return valve indicated generally 100 in the drawings. Return valve 100 is interposed in the return line FR and the valve operates to admit fuel returned from engine E back into the fuel module.

Fuel module 10 includes a housing 12 in which various components defining the fuel module, including return valve 100, are housed. Housing 12 is a generally cylindrical housing having a base 14, and circumferential sidewall 16. A recess 18 is formed at the base of the sidewall, and jet manifold 20 is mounted in this recess, externally of the module. Housing 12 is open at its upper end for installation of fuel module components into the housing. The housing also defines a reservoir R for fuel drawn from the fuel tank, and returned from engine E through valve 100.

A means 22 is provided for mounting fuel module 10within fuel tank T in a predetermined position within the tank. Means 22 includes a cover plate 24 to which fuel supply line FS and return line FR are attached in a spaced relation to one another. The cover plate is, in turn, attached to a top wall of the fuel tank to mount fuel module 10 in the tank. The fuel module is mounted generally vertically in the tank.

Next, a high pressure fuel pump 26 is mounted within the reservoir housing. Pump 26 is an electric pump having a low pressure inlet 28 and a high pressure outlet 30. Fuel is drawn into pump inlet 28 from the fuel reservoir defined by housing 12 and discharged from outlet 30 into an engine fuel supply manifold 32. The manifold is integrally formed with cover plate 24, and has an inlet section 34 into which high pressure fuel is directed from pump outlet 30. Fuel flowing into inlet section 34 divides into two flow paths. One path is to an engine outlet section 36 which connects to fuel supply line FS to move the fuel to engine E. The other path is to an outlet section 38 by which fuel is directed to jet manifold 20 which, as noted, is located outside housing 12.

Jet manifold 20 comprises three sections. A fuel inlet section 42 for fuel supplied from outlet 30 of fuel pump 26, an intermediate section 44 at which fuel is drawn from tank T into the fuel module, and an outlet section 46 for discharging fuel into reservoir R. Housing 12, which is of a molded plastic material, has an integrally formed fuel flow tube 48 extending upwardly from the bottom of the housing. The upper end of tube 48 is received in a fuel discharge opening 50 formed at an outlet 52 of manifold section 38. A reservoir line or tube 54 also integrally formed with housing 12 extends upwardly from bottom 14 of the housing. The upper end of tube 54 opens into reservoir R for fuel drawn through jet manifold 20 to discharge into the reservoir. An opening 5E, 58 respectively is formed in bottom 14 of housing 12 for fuel flow into and out of jet manifold 20 through respective flow tubes 48, 54.

Figure 6:
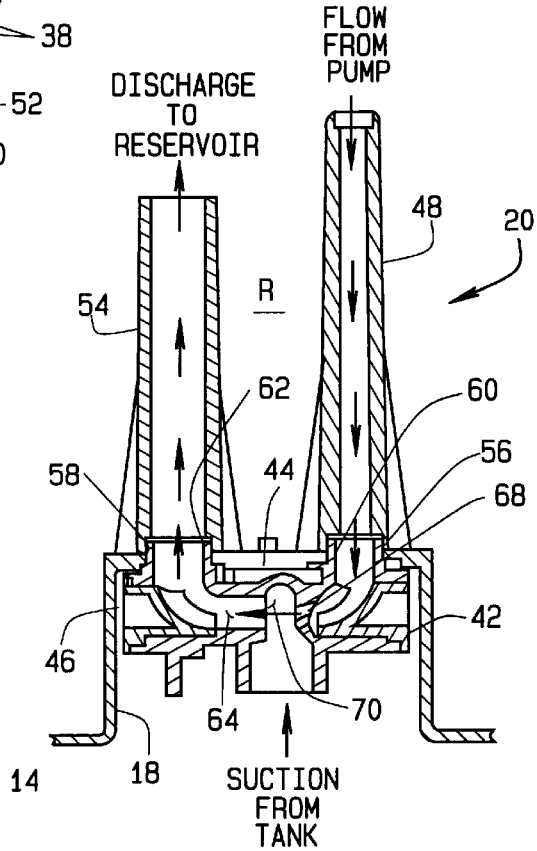
FIG. 6 is a sectional view of an external venturi jet manifold assembly comprising one improvement of the present invention; and, FIG. 7 is a sectional view of a return fuel portion of the module illustrating a return valve assembly comprising another improvement of the fuel module.
Figure 5:
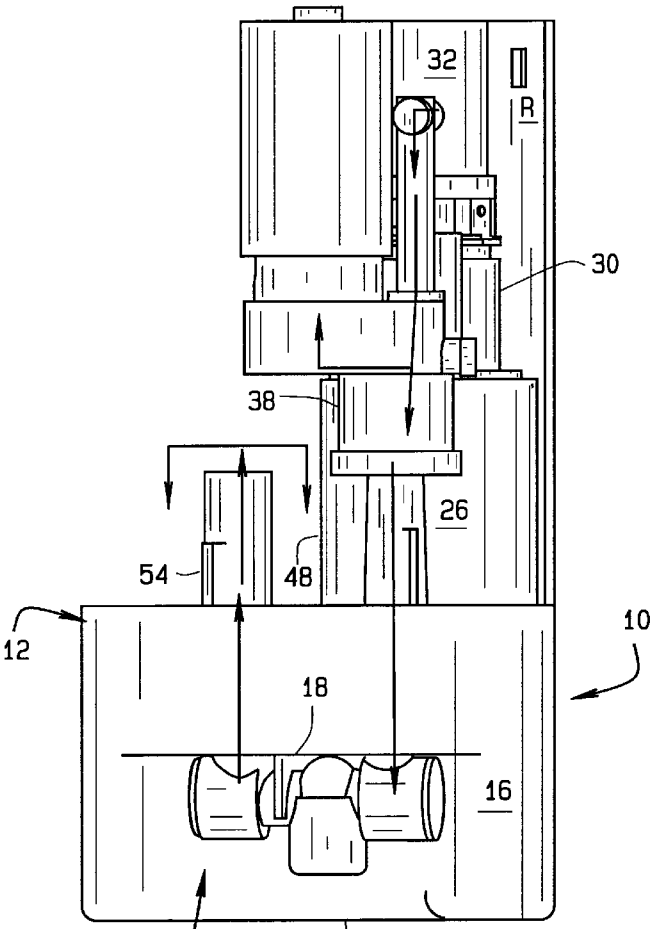
FIG. 5 is a second cut away portion thereof.
Figure 4:
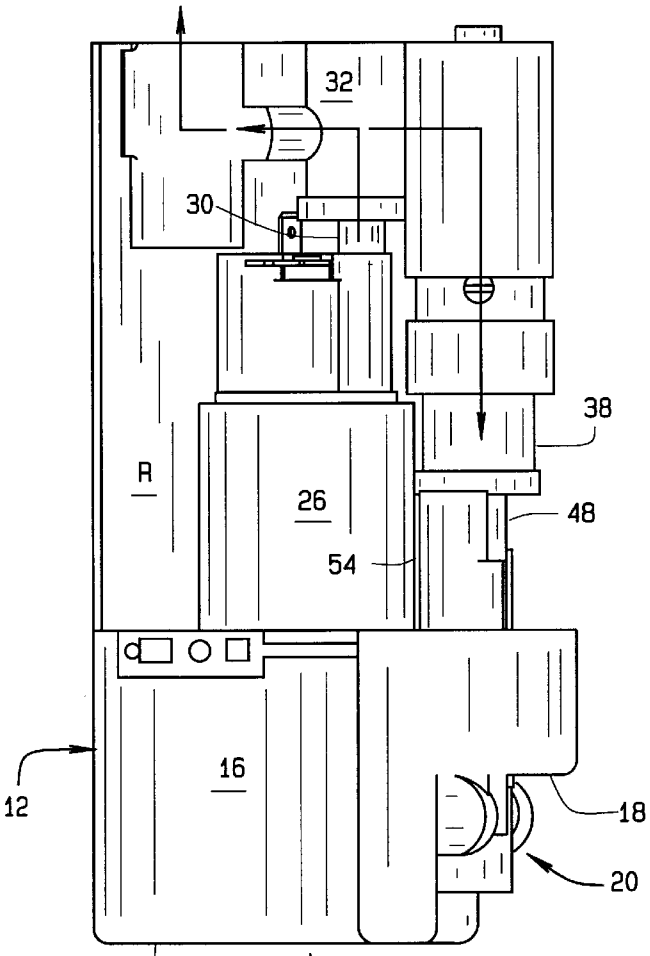
FIG. 4 is a first cut away portion of the fuel module.

Jet manifold 20 is a separate unit, also formed of a molded plastic material, mounted to housing 12 during assembly of module 10. Respective hollow nipples 60, 62 are formed on an upper surface of the manifold assembly, and are received in openings 56, 58 in bottom 14 of housing 12. A fuel flow passage 64 (see FIG. 6) extends from opening 56 and inlet section 42 through the jet manifold to opening 58 and outlet section 46. An opening 66 formed in intermediate section 44 of the jet manifold opens into the fuel tank for fuel to be drawn from the tank into the jet manifold.

A restriction 68 formed in passage 64, at the inner end of inlet section 42, comprises a nozzle. The section of passage 64 extending through intermediate section 44 of the jet manifold forms a venturi 70. As high pressure fuel from outlet 30 of fuel pump 26 is pushed through passage 64 and the nozzle 68 formed in the passage, the venturi 70 into which the fuel is discharged from the nozzle creates a low pressure region in the jet manifold. This creates suction at opening 66 which is in communication with fuel within fuel tank T. Fuel in the fuel tank is now drawn into the opening 66 by the suction created due to the low pressure. Fuel drawn through opening 66 is sucked into passage 64 and entrained with the fuel discharged from nozzle 68. The fuel from the two sources (high pressure fuel from the outlet of fuel pump 26 and fuel from tank T intermixes in the jet manifold assembly and the fuel mixture is dumped into reservoir R through tube 54. Since the fuel pump draws fuel into its inlet 28 from reservoir R, the fuel pump now supplies intermixed fuel to the fuel injection system of engine E.

As noted above, a second improvement to fuel module 10 is the fuel return valve 100 interposed in the return line for admitting fuel returned from the engine into the reservoir R. Fuel returning from engine E through return line FR flows through an opening 102 in cover plate 24 of the fuel module. A fuel return inlet tube 104 which is fitted into opening 102 during assembly of the fuel module, extends from cover plate 24 down into the reservoir housing. A housing 106 also extends down into the reservoir from the cover plate. Housing 106 has a central opening 108 through which tube 104 extends. Return valve 100 is installed at the inner end of housing 106. For this purpose, the inner end of housing 106 forms a chamber 110 and the return valve assembly is installed in this chamber.

The return valve assembly comprises a hollow, cylindrical frame 112 which fits into the chamber. The upper end of the frame, as viewed in FIG. 7, abuts against a shoulder 114 formed approximately midway along the length of chamber 110. O-rings 116 are fitted about the upper and lower ends of the frame to provide seals between the frame and housing sidewall. An upper surface 118 of the frame, again as viewed in FIG. 7, has a central opening 120. The opening forms a fuel inlet for the return valve. An opening 121 formed in a side of frame 112 comprises a fuel outlet for the valve. A plunger 122 is installed within frame 112 and is reciprocally movable within the frame, axially of the frame. Plunger 122 has a tip end 124 extending through opening 120, and a retainer 125 (fitted between the frame 112 and housing 106) extends over the tip end of the plunger to restrict axial movement of the plunger. A spring 126 seats against an inner wall of frame upper surface 118 and bears against a shoulder 128 formed at an inner end 130 of the plunger so to urge the plunger downwardly as viewed in FIG. 7. Plunger 122 has a center section 132 whose diameter is smaller than that of opening 120 in surface 118 of the frame. A bottom section 134 of the plunger has an outer diameter corresponding to the inner diameter of the frame. Tip end 124 of the plunger is larger in diameter than the diameter of opening 120. Accordingly, spring 126 acting on the plunger tends to pull the tip end of the plunger (which includes a sealing element) into the opening to close the opening.

Figure 7:
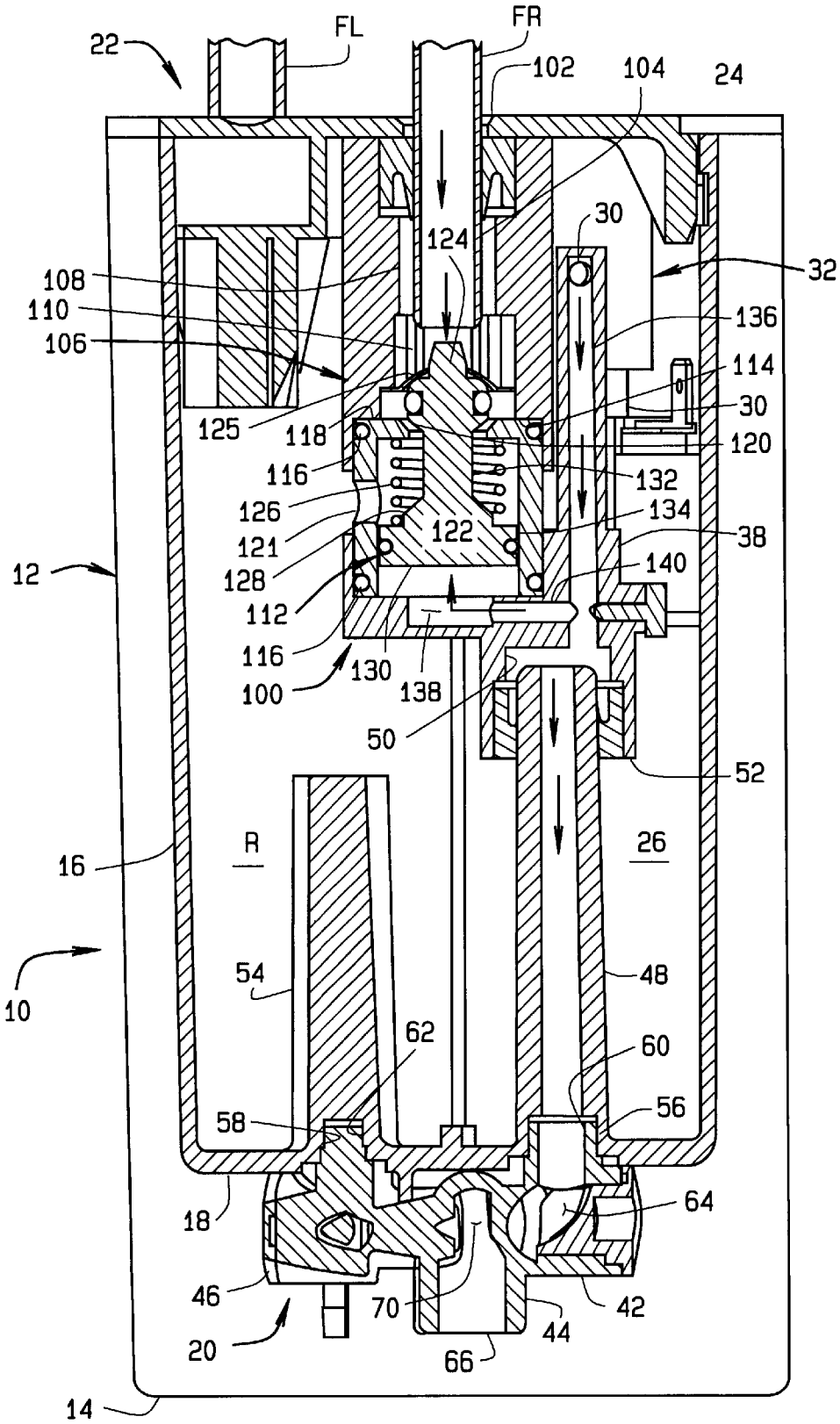

As noted above, fuel supply manifold 32 includes an outlet section or return housing 38 by which fuel is directed to jet manifold 20. A fuel passage 136 extends through this section 38 from outlet 30 of the fuel pump to the inner, inlet end of tube 48. A chamber 138, formed as part of return housing 38, houses the lower portion of valve housing 112 and is connected one end of a fuel passage 140. The other end of passage 140 opens into fuel passage 136. In accordance with the invention, when the engine is running and fuel pump 26 is pumping fuel to the engine, high pressure fuel from outlet 30 of the pump also flows through passage 136 to tube 48. A portion of this high pressure fuel from fuel pump 26 is diverted through passage 140 into chamber 138. The diverted fuel acts on end 130 of plunger 122 to move the plunger upwardly, as shown in FIG. 7, against the force of spring 126. This action displaces tip end 124 of the plunger from opening 120. This allows return fuel from the engine to flow into opening 120, and out through opening 126 in the side of frame 112 into reservoir R. When the engine is turned off, and fuel pump 26 stops operating, spring 126 again seats the tip end of the plunger into opening 120 to shut off the flow of return fuel into the reservoir.

What has been described is an improved fuel module assembly installed in the fuel tank of a motor vehicle and including a fuel pump of the module, for delivering fuel, under high pressure, to the vehicle's engine. The fuel pump is installed in a reservoir housing together with a manifold by which fuel is routed from the fuel pump to the engine. A portion of the fuel is also directed from the manifold, through a jet manifold assembly installed externally of the housing, into a reservoir from which inlet fuel for the fuel pump is drawn. The jet manifold assembly includes a nozzle and a venturi into which fuel drawn through the nozzle is discharged. The resulting low pressure region creates a suction by which fuel in the tank is drawn into the reservoir portion of the fuel module through the jet manifold assembly, the new fuel being intermixed with the high pressure fuel flowing through in the jet manifold assembly.

A return fuel valve incorporated in the fuel module allows return fuel from the engine to be discharged in the reservoir while the engine is running. The valve is interposed in a fuel return path from the engine and when the engine is shut off, a spring biases the valve closed. When the engine is running, high pressure fuel from the fuel pump overcomes the force of the spring and moves the plunger against the force of the spring to open the return valve.

In view of the foregoing, it will be seen that the several objects of the invention are achieved and other advantageous results are obtained.

What is claimed is:

1. In a fuel module for installation in a fuel tank, the module having a housing defining a fuel reservoir, a fuel pump installed in the housing and having an inlet and an outlet and discharging pressurized fuel from the outlet, a manifold in communication with the fuel pump outlet for receiving pressurized fuel from the fuel pump and directing the pressurized fuel through a fuel supply line connected to the manifold to a fuel injection system of an internal combustion engine, a return line returning fuel not consumed by the engine to the fuel module, the improvement comprising a jet manifold assembly mounted externally of the housing in fluid communication therewith, the jet manifold assembly including a nozzle in fluid communication with the manifold for receiving pressurized fuel from the fuel pump, a venturi into which fuel from the nozzle is discharged thereby to create a low pressure region, a fuel flow opening communicating with fuel in the fuel tank for drawing fuel from into the jet manifold assembly by a suction resulting from the low pressure, fuel drawn into the jet manifold assembly from the tank being entrained and intermixed with the fuel discharged through the nozzle, and a fuel flow line connected between an outlet of the jet manifold assembly and the reservoir to direct the intermixed fuel from the jet manifold assembly into the reservoir, the intermixed fuel now being supplied to the engine; and, a fuel return valve interposed in the return line for discharging fuel returned from the engine into the reservoir when the fuel pump is operating, the fuel return valve including a return housing having a fuel inlet and a fuel outlet, and a plunger movable within the housing to open and close the fuel return valve.

2. The improvement of claim 1 wherein the nozzle, low pressure region, and suction line are all located outside of the housing, and wherein the manifold has a fuel flow line extending through the housing for supplying high pressure fuel to the nozzle, the fuel flow line extending from the low pressure region into the housing for intermixed fuel to be discharged within the reservoir.

3. The improvement of claim 2 in which the housing has sidewalls, a closed bottom wall, an open end, and a cover for closing the open end, the fuel supply line and return line passing through and being secured to the cover.

4. The improvement of claim 3 further including means for mounting the fuel module within the fuel tank in a predetermined position within the tank.

5. The improvement of claim 4 wherein the mounting means includes a cover plate to which the fuel supply line and the return line are connected, the cover plate being attached to the fuel tank to mount the fuel module housing in a predetermined position within the fuel tank.

6. The improvement of claim 1 further including a spring seated within the return housing and acting on the plunger to urge the plunger to a position closing the fuel return valve.

7. The improvement of claim 6 wherein the fuel pump outlet is connected to the return housing for high pressure fuel to be directed to one side of the plunger and act on the plunger.

8. The improvement of claim 7 wherein high pressure fuel moves the plunger against the force of the spring, the plunger having a first section of a first diameter which seats in the fuel inlet of the return housing to block the inlet, and a second section of a second and smaller diameter which is moved into the fuel inlet of the return housing when the plunger is moved by high pressure from the fuel pump thereby to open the fuel inlet of the return housing and allow fuel returned from the engine to be discharged into the reservoir housing.

9. The improvement of claim 8 in which the plunger is held open by high pressure fuel directed to the plunger from the fuel pump when the fuel pump is operating.

10. An improved fuel module installed in a fuel tank for delivering fuel from the fuel tank to an internal combustion engine comprising:

a housing defining a fuel reservoir;

a fuel pump mounted in the housing and having a pump inlet and a pump outlet, the pump discharging fuel from the outlet under pressure;

a manifold in communication with the pump outlet for receiving fuel under pressure from the pump, a fuel supply line being connected to the manifold for supplying fuel under pressure to a fuel injection system of the engine, and a return line for returning fuel not consumed by the engine back to the reservoir;

a fuel return valve interposed in the return line for admitting fuel returned from the engine into the housing when the fuel pump is operating and including a return valve housing having a fuel inlet and a fuel outlet, and a plunger movable within the return valve housing to open and close the fuel return valve; and, a jet manifold assembly installed externally of the housing in fluid communication with the reservoir and including a nozzle in communication with the manifold for receiving fuel under pressure from the pump, a venturi into which fuel from the nozzle is discharged thereby to generate a low pressure region, a fuel opening in fluid communication with fuel within the fuel tank for fuel in the tank to be drawn into the jet manifold assembly by a suction created by the low pressure, fuel drawn into the jet manifold assembly being entrained and intermixed with the fuel discharged from the nozzle, and a fuel flow line connected between an outlet of the jet manifold assembly and the reservoir for directing intermixed fuel from the jet manifold assembly into the reservoir for the intermixed fuel to be pumped from the fuel module to the fuel injection system of the engine.

11. The improved fuel module of claim 10 in which the manifold includes a fuel flow line extending through the housing for supplying high pressure fuel to the nozzle, the fuel flow line extending from the low pressure region into the reservoir for intermixed fuel to be discharged into the reservoir.

12. The improved fuel module of claim 11 wherein the housing has sidewalls, a closed bottom wall, an open end, and a cover for closing the open end, the fuel supply line and return line passing through and being secured to the cover.

13. The improved fuel module of claim 12 further including a plate for mounting the fuel module within the fuel tank in a predetermined position within the tank, the fuel supply line and the return line being attached to the plate in a spaced relation, and the plate being attached to a surface of the fuel tank to hold the housing in a predetermined position within the fuel tank.

14. The improved fuel module of claim 10 further including a spring seated within the return housing and acting on the plunger to urge the plunger to a position closing the fuel return valve, the fuel pump outlet being connected to the return housing for high pressure fuel to be directed to one side of the plunger to act on the plunger.

15. The improved fuel module of claim 14 wherein high pressure fuel moves the plunger against the force of the spring, the plunger having a first section of a first diameter which seats in the fuel inlet of the return housing to block the inlet, and a second section of a second and smaller diameter which is moved into the fuel inlet of the return housing when the plunger is moved by high pressure fuel from the fuel pump thereby to open the fuel inlet of the return housing and allow fuel returned from the engine to be discharged into the reservoir.

16. An improved fuel module installed in a fuel tank for delivering fuel from the fuel tank to an internal combustion engine comprising:

a housing defining a fuel reservoir;

a fuel pump mounted in the housing and having a pump inlet and a pump outlet, the pump discharging fuel from the outlet under pressure;

a manifold in communication with the pump outlet for receiving fuel under pressure from the pump, a fuel supply line being connected to the manifold for supplying fuel under pressure to a fuel injection system of the engine, and a return line for returning fuel not consumed by the engine back to the reservoir; and, a fuel return valve interposed in the return line for admitting fuel returned from the engine into the reservoir when the fuel pump is operating, and including a return housing having a fuel inlet and a fuel outlet, and a plunger movable within the housing to open and close the fuel return valve.

17. The improved fuel module of claim 16 further including a spring seated within the return housing and acting on the plunger to urge the plunger to position closing the fuel return valve, the fuel pump outlet being connected to the return housing for high pressure fuel to be directed to one side of the plunger and act on the plunger and open the fuel return valve.

18. The improved fuel module of claim 17 wherein high pressure fuel moves the plunger against the force of the spring, the plunger having a first section of a first diameter which seats in the fuel inlet of the return housing to block the inlet, and a second section of a second and smaller diameter which is moved into the fuel inlet of the return housing when the plunger is moved by high pressure fuel from the fuel pump thereby to open the fuel inlet of the return housing and allow fuel returned from the engine to be discharged into the reservoir.

19. The improved fuel module of claim 16 further including a jet manifold assembly installed externally of the housing and in fluid communication with the reservoir, the jet manifold assembly including a nozzle in communication with the manifold for receiving fuel under pressure from the pump, a venturi into which fuel from the nozzle is discharged thereby to generate a low pressure region, an opening communicating with fuel within the fuel tank to draw fuel from the tank into the jet manifold assembly by the suction created by the low pressure, fuel drawn into the jet manifold assembly being entrained and intermixed with the fuel discharged from the nozzle, and a fuel line interconnected between an outlet of the jet manifold assembly and the reservoir for delivering the intermixed fuel into the reservoir for the intermixed fuel to be pumped by the fuel pump to the engine.

20. The improved fuel module of claim 19 in which the manifold includes a fuel flow line extending through the housing for supplying high pressure fuel to the nozzle, the fuel flow line extending from the low pressure region into the housing for intermixed fuel within to be discharged within the reservoir.

21. The improved fuel module of claim 20 wherein the housing has sidewalls, a closed bottom wall, an open end, and a cover for closing the open end, the fuel supply line and return line passing through and being secured to the cover.

22. The improved fuel module of claim 21 further including a plate for mounting the fuel module within the fuel tank in a predetermined position within the tank, the fuel supply line and the return line being attached to the plate in a spaced relation, and the plate being attached to a surface of the fuel tank to hold the housing in a predetermined position within the fuel tank.

23. A fuel module installed in a fuel tank for delivering fuel from the fuel tank to an internal combustion engine comprising:

a housing defining a fuel reservoir;

a fuel pump mounted in the housing and having a pump inlet and a pump outlet, the pump discharging fuel from the outlet under pressure;

a manifold in communication with the pump outlet for receiving fuel under pressure from the fuel pump, a fuel supply line being connected to the manifold for supplying fuel under pressure to a fuel injection system of the engine, and a return line for returning fuel not consumed by the engine back to the reservoir;

a fuel return valve interposed in the return line for admitting fuel returned from the engine into the reservoir when the fuel pump is operating, and including a valve housing having a fuel inlet and a fuel outlet, and a plunger movable within the valve housing to open and close the fuel return valve; and, a jet manifold assembly installed externally of the housing and in fluid communication with the reservoir, the jet manifold assembly including a nozzle in communication with the manifold for receiving fuel under pressure from the fuel pump, a venturi into which fuel from the nozzle is discharged thereby to create a region of low pressure, an opening in fluid communication with fuel in the fuel tank for drawing fuel into the jet manifold assembly by a suction due to the low pressure, fuel drawn into the jet manifold assembly being entrained and intermixed with fuel discharged from the nozzle, and a fuel line in communication with an outlet of the jet manifold assembly and the reservoir for the fuel drawn into the jet manifold assembly and entrained and intermixed with the fuel discharged from the nozzle to be delivered to the reservoir, the intermixed fuel being drawn into the inlet of the fuel pump and pumped to the engine.

* * * * *

UNITED STATES PATENT AND TRADEMARK OFFICE

CERTIFICATE OF CORRECTION

PATENT NO. : 6,718,952 B2
DATED : April 13, 2004
INVENTOR(S) : Finch

It is certified that error appears in the above-identified patent and that said Letters Patent is hereby corrected as shown below:

Column 1,
Line 57, replace “create” with -- creates --.

Column 3,
Line 6, replace “10within” with -- 10 within --.
Line 40, replace “5E” with -- 56 --.

Signed and Sealed this

Twenty-fourth Day of January, 2006

JON W. DUDAS
*Director of the United States Patent and Trademark Office*